US005507270A

United States Patent [19]

Smith

[11] Patent Number: 5,507,270

[45] Date of Patent: Apr. 16, 1996

[54] LIMB POCKET AND POCKET LINER FOR ARCHERY BOW

[75] Inventor: Allan E. Smith, Tucson, Ariz.

[73] Assignee: Precision Shooting Equipment, Inc., Tucson, Ariz.

[21] Appl. No.: 300,656

[22] Filed: Sep. 6, 1994

[51] Int. Cl.[6] ..... F41B 5/00

[52] U.S. Cl. ..... 124/23.1; 124/86

[58] Field of Search ..... 124/23.1, 24.1, 124/25.6, 86, 88

[56] References Cited

U.S. PATENT DOCUMENTS

| | | | |
|---|---|---|---|
| 3,921,598 | 11/1975 | Helmick | 124/23.1 |
| 4,078,538 | 3/1978 | Shepley | 124/25.6 |
| 4,574,766 | 3/1986 | Izuta | 124/23.1 |
| 5,172,679 | 12/1992 | Mussack | 124/25.6 |
| 5,231,970 | 8/1993 | Ploot et al. | 124/23.1 |
| 5,280,779 | 1/1994 | Smith | 124/88 |
| 5,339,790 | 8/1994 | Smith | 124/25.6 |
| 5,411,008 | 5/1995 | Hsu | 124/23.1 |

*Primary Examiner*—Terry Lee Melius
*Assistant Examiner*—John A. Ricci
*Attorney, Agent, or Firm*—Cahill, Sutton & Thomas

[57] ABSTRACT

A limb pocket is provided with a plurality of plastic inserts located about the interior of the pocket for receiving the butt of a limb. The interior width of the pocket is greater than the width of the butt of the limb and the inserts reduce the interior width of the pocket to less than the width of the limb butt. The inserts are tapered and slightly resilient to assure a close fit between the pocket and the limb. The end wall of the pocket optionally includes inserts for separating the end of the limb from the end wall of the pocket. The walls and floor of the pocket include shallow recesses for locating the inserts.

20 Claims, 2 Drawing Sheets

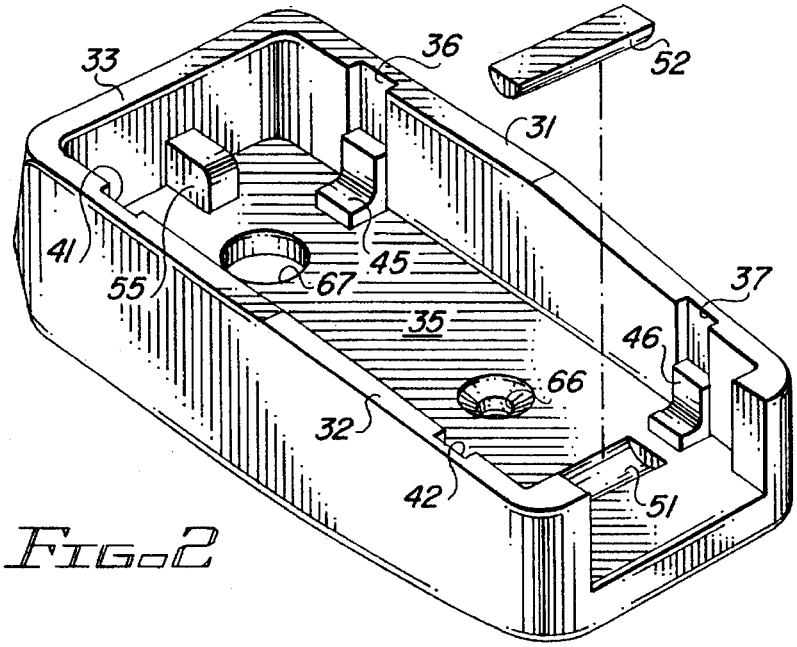
FIG. 2
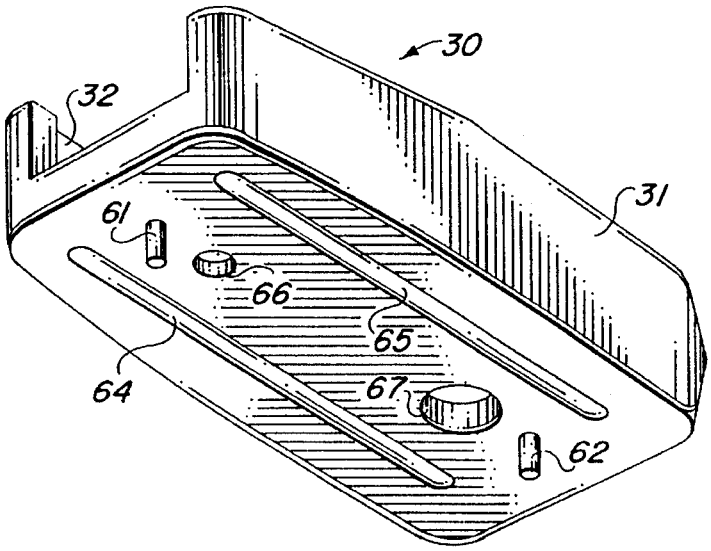
FIG. 3
FIG. 6
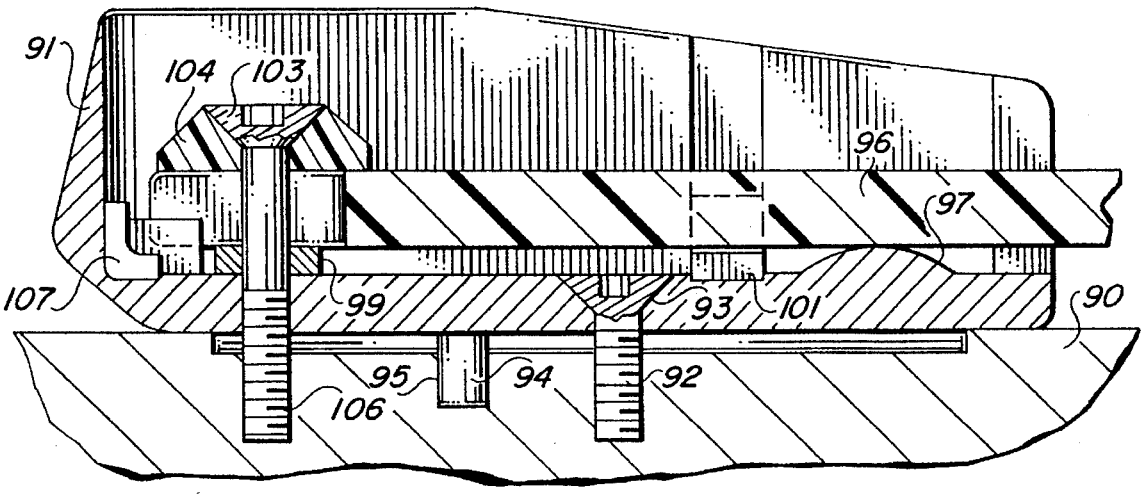

LIMB POCKET AND POCKET LINER FOR ARCHERY BOW

BACKGROUND OF THE INVENTION

This invention relates to archery bows and, in particular, to a limb pocket for an archery bow.

Archery bows are available in a variety of forms such as long bows, recurve bows, compound bows, and others. This invention is directed to those archery bows wherein the limbs can be separated from the handle and is specifically directed to overcome the difficulties that may be encountered in the manufacture, mounting, adjustment, and use of limbs attached to a bow handle.

A recurve bow or a compound bow is typically made in three pieces: an elongated, rigid handle and a pair of limbs. The limbs overlap the ends of the handle a short distance and are cantilever mounted to the ends of the handle. A pocket at each end of the handle receives the end of a limb. Each limb is held in place by a limb bolt passing through a hole or slot in the butt of the limb and engaging a threaded bore in the handle. The hole or slot does not closely fit around the limb bolt, which is used for adjusting the draw weight of the bow.

A transverse, semi-circular trough at the outer end of each pocket receives a half-round member having its flat side facing the underside of the limb. As used herein, the "underside" or "inside" of a limb is the side facing an archer holding a drawn bow. The "outside" surface of a limb is the generally convex side facing the target. The underside of the limb does not touch the pocket but rests on the member, which serves as a pivot for the limb as the limb bolt is tightened or loosened and as the bow is drawn and fired. The distance from the pivot to the free end of the limb is considerably greater than the distance from the pivot to the limb bolt. The large forces in the bow are therefore concentrated at the limb pocket.

There are problems with this construction of a bow. A first problem is that the placement of the limb is critical. Any slight misalignment of the limb increases the shear forces on the pocket and may cause the limb to rub and wear in the pocket. Abrasion of the butt of a limb may lead to cracking or splintering of the limb at the limb bolt if the misalignment is not corrected.

A compound bow differs from a long bow in that a block and tackle mechanism is used to bend the bow: pulleys or wheels are attached at the free ends of the limbs to obtain a mechanical advantage in bending the bow. The limbs can be made approximately three times as stiff as for a longbow of the same draw weight. Eccentrically mounted wheels enable one to use a much higher maximum draw weight because they provide a substantial "let off" or reduction in the holding force of a drawn bow.

The combination of stiffer limbs and greater draw weight applies large forces to the components of a compound bow and these forces can have a moment from the centerline of the bow and/or from the plane of a drawn bowstring. The forces from the bowstring and cables wound on the wheels may not align with the mounting of the limb to the handle, e.g. because of the way the bowstring and cables are wound or because of a sideward force caused by a finger release or a sideward force due to a cable guard. The result is a force tending to move the free ends of the limbs from side to side when the bow is drawn and/or fired. Thus, the structure for attaching the limbs to the handle must be substantial enough to resist these forces in order for the bow to perform consistently. Whether for target shooting or for hunting, archers continually strive for consistent technique. If a bow does not perform consistently, this effort is pointless.

In view of the foregoing, it is therefore an object of the invention to provide an improved limb attachment for an archery bow.

Another object of the invention is to provide a pocket having a resilient liner for receiving the butt of a bow limb.

A further object of the invention is to provide a pocket for a bow limb having low friction bearing surfaces for receiving the butt of a bow limb.

SUMMARY OF THE INVENTION

The foregoing objects are achieved in the invention wherein a limb pocket is provided with a plurality of plastic inserts located about the interior of the pocket for receiving the butt of a limb. The interior width of the pocket is greater than the width of the butt of the limb. The inserts reduce the interior width of the pocket to less than the width of the limb butt and are tapered and slightly resilient to assure a close fit between the pocket and the limb. The end wall of the pocket optionally includes inserts for separating the end of the limb from the end wall of the pocket. The walls and floor of the pocket include shallow recesses for locating the inserts.

BRIEF DESCRIPTION OF THE DRAWINGS

A more complete understanding of the invention can be obtained by considering the following detailed description in conjunction with the accompanying drawings, in which:

FIG. 2 is a perspective view showing the inside of a pocket constructed in accordance with a preferred embodiment of the invention;

FIG. 3 is a perspective view of the outside of the pocket shown in FIG. 2;

FIG. 6 is a cross-section of a pocket constructed in accordance with the invention.

DETAILED DESCRIPTION OF THE INVENTION

Figure 1:
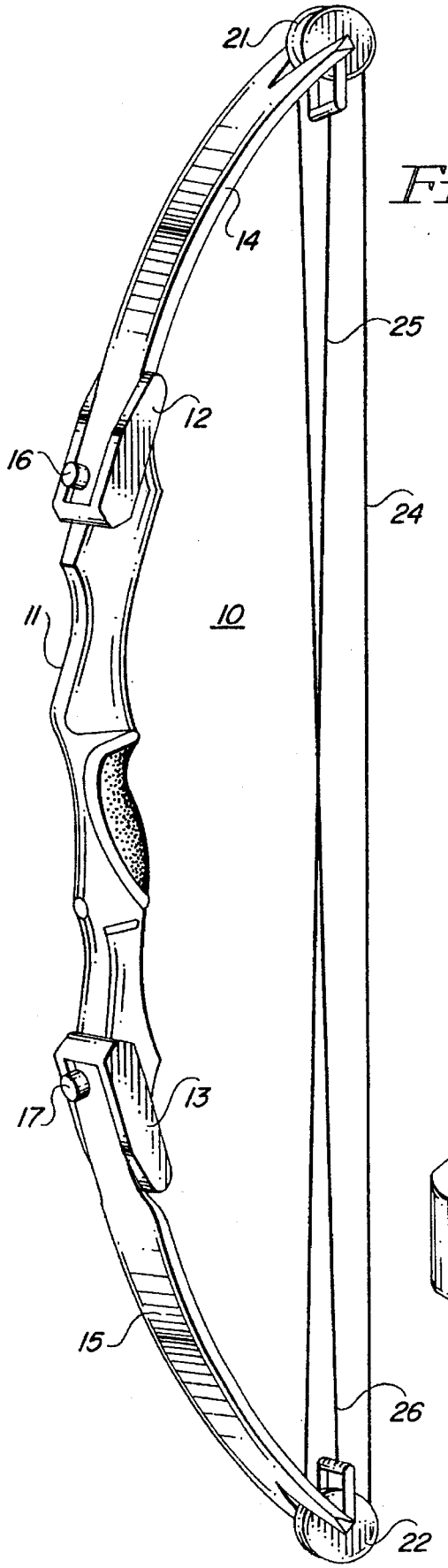
FIG. 1 illustrates a compound bow constructed in accordance with the invention.

In FIG. 1, compound bow 10 includes handle 11 having pockets 12 and 13 attached to respective ends of the handle by bolts (not shown in FIG. 1). The butt of limb 14 fits within pocket 12 and is fastened by limb bolt 16. The butt of limb 15 fits within pocket 13 and is fastened by limb bolt 17. Pulleys 21 and 22 are mounted on axles attached to the free ends of limbs 14 and 15, respectively. Lacing, including bowstring 24 and cables 25 and 26, interconnect pulleys 21 and 22. As bow 10 is drawn and fired, the violent straightening of limbs 14 and 15 is coupled to pockets 12 and 13, which must hold the limbs in place while the vibrations in the limbs and lacing subside.

FIGS. 2 and 3 are top and bottom views, respectively, of a pocket constructed in accordance with a preferred embodiment of the invention. Pocket 30 includes side wall 31 and side wall 32 interconnected by end wall 33. These walls, and floor 35, are not separate elements but are portions of a single article which is cast or machined from aluminum alloy or magnesium alloy or hard plastic. Side wall 31 includes recesses 36 and 37, and side wall 32 includes recesses 41 and 42. Floor 35 includes small recesses aligned with the recesses in the side walls and end wall. The recesses in pocket 30 each receive an insert which preferably is made from plastic or other resilient material.

Side wall 31 and side wall 32 are separated by a distance greater than the width of the butt of a limb. Inserts, such as inserts 45 and 46, reduce the width of the pocket to less than the width of the butt of a limb, assuring that the limb fits snugly within pocket 30. It is preferred, but not necessary, that the inserts in the opposed side walls be directly opposite one another, i.e. lie on a line approximately perpendicular to the length of a limb.

Trough 51 is located adjacent the open end of pocket 30 and is parallel to the open end. Pivot 52 is preferably a half round made from plastic and rests in trough 51. While referred to as "half round", it is understood that the member need not have a semi-circular cross-section but can include any desired curve. Similarly, the trough need not have a semi-circular cross-section. At end wall 33, key 55 extends perpendicularly to wall 33 and provides a mechanism for locating the butt of a limb. Key 55 fits within the slotted end of a limb.

FIG. 3 shows the underside of floor 35 which includes pins 61 and 62 extending from floor 35 for locating pocket 30 on the end of a handle having bores spaced the same distance apart as the pins. Pocket 30 is also located on a handle by ridges 64 and 65 which run parallel to the length of pocket 30. Ridges 64 and 65 are separated by a distance slightly greater than the thickness of the end of the handle. Pins 61 and 62 and ridges 64 and 65 provide a mechanism for quickly locating and temporarily attaching pocket 30 to the end of a bow handle.

Pocket 30 is secured to a handle by way of a bolt through hole 66. Hole 66, as seen from above in FIG. 2, is countersunk for receiving a flat head bolt which locates the pocket by way of the tapered fit between the head of the bolt and the taper of the hole. The bolt secures the pocket to a handle by engaging a threaded bore in the handle. Hole 67 in pocket 30 has a diameter slightly greater than the diameter of a limb bolt which passes through a limb (not shown) and hole 67 to engage a threaded bore or anchor within a handle.

Figure 4:
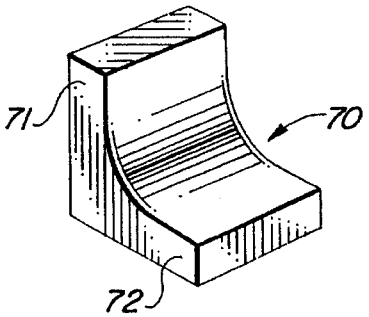
FIG. 4 is a perspective view of an insert for use in a pocket constructed in accordance with the invention.

The inserts are attached to pocket 30 by an adhesive applied along the back and bottom of each insert. FIG. 4 illustrates an insert in greater detail. As illustrated in FIG. 4, insert 70 includes a back portion 71 and a bottom portion 72. Back portion 71 is preferably tapered, having a smaller thickness at the end or top and a greater thickness where the back joins bottom portion 72. Bottom portion 72 can be tapered or have a uniform thickness. Back portion 71 forms a wedge, between a side wall and the butt of a limb, for locating the limb within a pocket. Bottom portion 72 has a sufficient thickness to provide some clearance between the butt of the limb and the floor of the pocket. Pivot 52 (FIG. 2) is thicker than bottom portion 72, thereby assuring that a limb rests on pivot 52 and not on the bottom portions of the inserts near the open end of the pocket.

Figure 5:
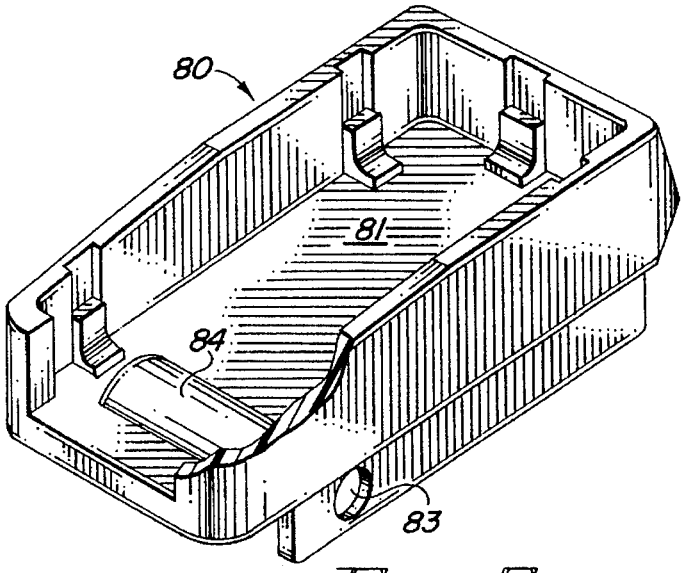
FIG. 5 is a perspective view showing the inside of a pocket constructed in accordance with an alternative embodiment of the invention.

FIG. 5 illustrates a pocket constructed in accordance with an alternative embodiment of the invention in which the pocket is fastened to a bow handle in such a way that the pocket can pivot. U.S. Pat. No. 5,280,779 (Smith) discloses an archery bow having a pivoting pocket. In pocket 80, the ridges on the underside of floor 81 have been extended to form a pair of walls which are located on either side of the handle. A pin through hole 83, and a corresponding hole in the ridge on the other side of pocket 80, fastens the pocket to the end of a handle and permits the pocket to pivot about the pin. The construction of pocket 80 is otherwise similar to that of pocket 30 except that pivot 84 is a convex surface and an integral part of pocket 80.

FIG. 6 illustrates the connection between the end of a handle and a limb utilizing a pocket in accordance with the invention. Bow handle 90 is attached to pocket 91 by flat head bolt 92 passing through hole 93 in the floor of pocket 91. Pocket 91 includes pin 94 inserted into an unthreaded hole 95 in the end of handle 90. Limb 96 rests on pivot 97 at the open end of pocket 91 and rests on insert 99 at the closed end of pocket 91. Insert 101 has a bottom portion which does not contact limb 96. Thus, limb 96 is free to flex about pivot 97 as the bow is drawn and fired. The end of limb 96 is held in place by limb bolt 103 passing through conical washer 104 and engaging threaded bore 106 in handle 90. Insert 107 prevents the end of limb 96 from engaging pocket 91 due to longitudinal motion of limb 96 during firing of the bow.

Thus, a pocket constructed in accordance with the invention accurately locates a limb and prevents the limb from engaging the hard surfaces of a pocket which can cause deterioration or failure of the limb or a disconcerting rattle as the bow is fired.

Having thus described the invention, it will be apparent to those of skill in the art that various modifications can be made within the scope of the invention. For example, an elastomeric material can be used for the inserts instead of plastic. In addition, a one-piece liner of resilient material can be used instead of separate inserts. Although the pockets shown in FIGS. 2–6 are separate pockets, the invention also applies to a bow handle having integral pockets. Although recesses in the walls of the pocket are preferred for locating the inserts and facilitating assembly of the pockets, the recesses can be eliminated and the inserts held in place by adhesive.

I claim:

1. An archery bow comprising:

(a) a handle having a first end and a second end;

(b) a first limb pocket on said first end and a second limb pocket on said second end;

(c) a first limb having a first end attached to said first pocket and a second end;

(d) a second limb having a first end attached to said second pocket and a second end;

(e) a bowstring interconnecting the second ends of said first and second limbs;

(f) wherein said first limb pocket and said second limb pocket each includes a pair of opposed side walls, a floor interconnecting said side walls, and an end wall interconnecting said side walls;

(i) wherein each of said opposed side walls includes at least one insert; and (ii) wherein said side walls are separated by a distance greater than the width of the butt of a limb and the inserts reduce the distance to less than the width of the butt of a limb.

2. The archery bow as set forth in claim 1 wherein said end wall includes at least one insert.

3. The archery bow as set forth in claim 1 wherein each of said opposed side walls includes at least one recess and said floor includes recesses aligned with and adjacent to corresponding recesses in said side walls and said inserts fit into the recesses in said floor and into the adjacent recesses in said side walls.

4. The archery bow as set forth in claim 1 and further comprising:

at least one pin attached to the floor of each limb pocket and extending away from the limb pocket for aligning the limb pocket with said handle.

5. The archery bow as set forth in claim 1 and further comprising:

a pair of ridges on the underside of each of said first limb pocket and said second limb pocket, said ridges extending parallel to said opposed side walls for aligning said limb pockets with said handle.

6. The archery bow as set forth in claim 5 wherein said ridges extend away from the pocket and form a pair of lower walls and each of said lower walls includes a hole for receiving a pivot pin to attach the pocket to said handle, whereby each pocket can pivot about said hole relative to said handle.

7. The archery bow as set forth in claim 1 wherein said inserts are tapered.

8. The archery bow as set forth in claim 1 wherein said first limb pocket and said second limb pocket each include a limb pivot.

9. The archery bow as set forth in claim 8 wherein each limb pivot is an integral part of the limb pocket.

10. The archery bow as set forth in claim 8 wherein each limb pocket includes a transverse trough and a half round member in said trough between the limb and the pocket.

11. The archery bow as set forth in claim 1 wherein said inserts are made from a resilient plastic.

12. The archery bow as set forth in claim 1 wherein said inserts are made from a resilient elastomeric material.

13. The archery bow as set forth in claim 1 wherein said floor includes a pair of holes, wherein one of said pair of holes receives the limb bolt and the other of said pair of holes is countersunk.

14. The archery bow as set forth in claim 13 and further comprising:

a flat head bolt through the countersunk hole in each pocket for attaching the pockets to said handle.

15. A limb pocket for receiving the butt end of a limb for an archery bow and for attaching said limb to the handle of said archery bow, said limb pocket comprising:

a pair of opposed side walls, a floor interconnecting said side walls, an end wall interconnecting said side walls, an open end opposite said end wall, and a limb pivot adjacent said open end;

(i) wherein each of said opposed side walls includes at least one recess and an insert in said recess;

(ii) wherein the distance between the insert in one side wall and the insert in the opposite side wall is equal to or less than the width of the butt end of a limb; and (iii) wherein said floor includes at least one hole.

16. The limb pocket as set forth in claim 15 wherein said limb pivot is an integral part of said limb pocket.

17. The limb pocket as set forth in claim 15 wherein said limb pivot includes a transverse trough in said floor and a half round member in said trough.

18. The limb pocket as set forth in claim 15 wherein said inserts are made from a resilient plastic.

19. The limb pocket as set forth in claim 15 wherein said inserts are made from a resilient elastomeric material.

20. The limb pocket as set forth in claim 15 wherein said inserts are tapered.

* * * * *